US005996350A

United States Patent [19]

Meseth

[11] Patent Number: 5,996,350

[45] Date of Patent: Dec. 7, 1999

[54] METHOD AND APPARATUS FOR THE SUPERHEATING OF STEAM

[75] Inventor: Johann Meseth, Dieburg, Germany

[73] Assignee: Siemens Aktiengesellschaft, Munich, Germany

[21] Appl. No.: 09/005,698

[22] Filed: Jan. 12, 1998

[30] Foreign Application Priority Data

Jan. 10, 1997 [DE] Germany ..... 197 00 652

[51] Int. Cl.[6] ..... F01K 25/02

[52] U.S. Cl. ..... 60/650; 60/653; 60/676

[58] Field of Search ..... 60/650, 653, 676

[56] References Cited

U.S. PATENT DOCUMENTS

| | | | |
|---|---|---|---|
| 3,979,914 | 9/1976 | Weber | 60/653 X |
| 4,526,006 | 7/1985 | Anthony | 60/653 X |
| 4,530,212 | 7/1985 | Schwerdtner et al. | 60/653 X |
| 4,589,258 | 5/1986 | Bockh | 60/653 X |

FOREIGN PATENT DOCUMENTS

| | | |
|---|---|---|
| 151464 | 1/1903 | Germany . |
| 3836461A1 | 5/1990 | Germany . |
| 4343088 A1 | 6/1995 | Germany . |

*Primary Examiner*—Hoang Nguyen
*Attorney, Agent, or Firm*—Herbert L. Lerner; Laurence A. Greenberg

[57] ABSTRACT

An apparatus and a method for the superheating of steam is used, in particular, for converting saturated steam into hot steam in the field of nuclear energy generation. As a result of at least partial conversion of pressure energy of the steam into kinetic energy, in particular into kinetic energy of a rotational flow, the steam cools and condensate and residual steam are generated. After the condensate has been separated from the residual steam, the latter is superheated as a result of a reduction of its kinetic energy and is converted into hot steam.

17 Claims, 4 Drawing Sheets

METHOD AND APPARATUS FOR THE SUPERHEATING OF STEAM

BACKGROUND OF THE INVENTION

Field of the Invention

The invention relates to a method and an apparatus for the superheating of steam, which may be used, for example, in the field of energy generation, in order to convert saturated steam generated in a power station into hot steam.

Light water nuclear reactors, which include boiling water and pressurized water reactors, are used, inter alia, as power stations for energy generation. As a result of the development of heat in a reactor core, wet steam is generated in a reactor pressure vessel in the case of boiling water reactors and in steam generators in the case of pressurized water reactors. In order to reduce the moisture content of the wet steam which is initially present, steam driers are disposed in the reactor pressure vessel or in the steam generator. The saturated steam that is generated in the reactor pressure vessel has a pressure of approximately 70 bar and a temperature of approximately 286 ° C. and is supplied to a turbine which drives a generator for generating electric energy. As a rule an intermediate superheater is disposed downstream of the high pressure turbine since appreciable quantities of steam condense in the turbine during depressurization. The condensate which has occurred is separated in the superheater and the remaining steam is heated slightly. That process step can be avoided if superheated steam is available from the outset.

German Published, Non-Prosecuted Patent Application DE 38 36 461 A1 discloses a low temperature steam generator having a vertical cylindrical casing which is subdivided into an upper chamber and a lower chamber through the use of a horizontal partition. A hot liquid, which contains steam if appropriate, flows into the upper chamber to form a rotational flow. The liquid flows through an orifice in the partition into the lower chamber and at the same time is accelerated. As a result of the acceleration, the pressure in the liquid decreases, and steam is generated, which is discharged vertically upward from the upper chamber. The liquid leaves the chamber out of the lower chamber. However, the generated steam is not present as hot steam.

German Patent 151 464 discloses an apparatus for converting saturated steam into superheated steam. In that apparatus, steam is set in a rotational flow with the aid of a screw disposed in a casing. In that instance, condensate is generated, which flows off downward on the screw threads as the result of gravity. The screw has a hollow cylinder inside it, into which the steam can enter through slits. The steam flows vertically upward in the hollow cylinder and leaves the apparatus as superheated steam through a slide.

SUMMARY OF THE INVENTION

It is accordingly an object of the invention to provide a method and an apparatus for the superheating of steam, which overcomes the hereinafore-mentioned disadvantages of the heretofore-known methods and apparatuses of this general type.

With the foregoing and other objects in view there is provided, in accordance with the invention, a method for the superheating of steam, which comprises at least partially converting a pressure energy of steam into a rotational flow about an axis of rotation and into an axial flow superposed on the rotational flow and flowing in direction of the axis of rotation; increasing a rotational velocity of the steam in the direction of the axis of rotation by reducing a flow cross-section while generating condensate and residual steam; separating the condensate from the residual steam upstream of the reduction of the flow cross-section and subsequently discharging the condensate essentially radially outward; and further conveying the residual steam in the direction of the axis of rotation while reducing the rotational velocity of the residual steam and superheating and converting the residual steam into hot steam.

The advantage of this method can be seen in the fact that the effect, namely the superheating of steam, is achieved on the basis of physical changes of state of the steam without external energy sources. When the pressure energy of the steam is converted into kinetic energy of the rotational flow, the steam expands, with the result that both the pressure and the temperature of the steam decrease. Due to the lower temperature which is then present, liquid condenses out of the steam, at the same time emitting condensation heat, and forms a condensate.

The condensate is centrifuged off, that is to say separated, from the residual steam, that is to say the steam fraction which is not condensed out, as a result of the rotational flow and is subsequently discharged radially outward. In this case, the residual moisture of the residual steam, that is to say the liquid fraction in this residual or wet steam, becomes lower as the rotational velocity of the rotational flow becomes higher. An increase in the rotational velocity is achieved in a simple way by reducing the flow cross-section. The area oriented perpendicularly to the axis of rotation is designated as the flow cross-section. After the condensate has been separated, the kinetic energy of the residual steam is converted into pressure energy again by reducing its velocity. This is preferably achieved by increasing the flow cross-section. This results in the temperature and pressure of the residual steam rising again. Since the residual steam can now no longer transfer the previously absorbed condensation heat to the condensate which has been separated in the meantime, the residual steam is superheated, that is to say it is present as hot steam. The temperature of the generated hot steam essentially becomes higher, the more complete the conversion of pressure energy into kinetic energy and the lower the residual moisture of the residual steam before its velocity is reduced again for conversion into pressure energy.

The pressure energy of the steam can be converted in a simple way into kinetic energy of the rotational flow. An axial flow in the direction of the axis of rotation is superposed on the rotational flow. The resulting flow may therefore be interpreted as a helical flow of the steam which is composed of an axial flow and a rotational flow. The advantage of a rotational flow is that, in this case, the flow velocity of the steam can easily be varied and, consequently, the conversion of pressure energy into kinetic energy can be carried out easily and without any appreciable efficiency losses. This is carried out by utilizing the basic physical principle of the conservation of angular momentum: the more the steam approaches the axis of rotation, the higher its circumferential velocity becomes and the more pressure is converted into kinetic energy. Conversely, kinetic energy can be converted back into pressure again by leading the steam further away from the axis of rotation.

In accordance with another mode of the invention, the steam forming the rotational flow enters a chamber, specifically tangentially to a shell of the chamber and approximately perpendicularly to the axis of rotation of the rotational flow. In this case, the steam flows through the chamber in the direction of the axis of rotation, that is to say in the axial direction of flow. The tangential entry of the steam into a chamber, which is preferably rotationally symmetrical, assists the buildup of a rotational flow and the conversion of pressure energy into kinetic energy.

In accordance with a further mode of the invention, the condensate is discharged from the shell of the chamber and, if appropriate, collected previously on the shell. As a result of the rotational flow, a cylindrical water layer forms on the shell of the chamber. It is therefore advantageous to discharge the condensate directly from the shell of the chamber. The condensate may, if appropriate, be collected before being discharged, so that the thickness of the water layer increases. The pressure in the separated condensate rises with increasing thickness. There is therefore the possibility of conveying the condensate counter to an external pressure.

With the objects of the invention in view there is additionally provided a method for generating hot steam from saturated steam in a nuclear power plant, which comprises generating the saturated steam in a reactor pressure vessel of a boiling water reactor plant.

With the objects of the invention in view there is also provided an apparatus for the superheating of steam, comprising a) a chamber having an axis of rotation and extending in direction of the axis of rotation; the chamber having an entry region for at least partially converting pressure energy of steam into kinetic energy of the steam and for separating a condensed-out condensate from remaining residual steam, the entry region having a given cross-sectional area; the chamber having a transitional region following the entry region for increasing the kinetic energy, the transitional region having a cross-sectional area smaller than the given cross-sectional area; the chamber having an exit region following the transitional region for reducing kinetic energy of the residual steam and for converting the residual steam into hot steam, the exit region having a cross-sectional area larger than the cross-sectional area of the transitional region; and the exit region having a first outlet for the hot steam, the entry region having a second outlet for the condensate, and the second outlet spaced radially from the axis of rotation.

In accordance with another feature of the invention, the chamber is of simple construction and is largely free of internal fixtures. The simple structure ensures reliable and dependable system management.

In accordance with a further feature of the invention, the chamber is essentially rotationally symmetrical about an axis of rotation. An inlet is disposed in the entry region in such a way that a rotational flow forms in the entry region. As a result of the rotational flow, the condensate is centrifuged off and, consequently, the residual moisture in the residual steam is reduced. During operation, the steam flows through the chamber in the direction of the axis of rotation which is preferably oriented essentially horizontally.

In accordance with an added feature of the invention, in order to build up the rotational flow, the inlet is disposed tangentially to the shell of the chamber and essentially perpendicularly to the axis of rotation.

In accordance with an additional feature of the invention, the inlet is constructed as a nozzle, for converting the pressure energy into kinetic energy.

In accordance with yet another feature of the invention, the first outlet is disposed on the shell of the chamber in the direction of the rotational flow tangentially and essentially perpendicularly to the axis of rotation and in the direction of the tangential flow component of the rotational flow, in order to convert the kinetic energy of the residual steam largely into pressure energy again and thus increase to the temperature as much as possible. The tangential, that is to say the rotating flow component of the residual steam thereby flows directly into the first outlet. At the same time, the rotational flow loses its kinetic energy, with the result that the pressure and the temperature of the residual steam are increased again and hot steam is formed.

In accordance with yet a further feature of the invention, the second outlet is likewise disposed tangentially to the shell of the chamber and essentially perpendicularly to the axis of rotation.

In accordance with yet an added feature of the invention, the second outlet is disposed essentially in the direction of the rotational flow, that is to say in the direction of the tangential flow component. This ensures that the rotating condensate which is centrifuged off can flow directly into the second outlet, so that the kinetic energy of this condensate stream is largely converted into dynamic pressure. As a result, the condensate can also flow out of the inlet region counter to an external pressure.

In accordance with yet an additional feature of the invention, the second outlet is spaced further from the axis of rotation than the inlet.

In accordance with again another feature of the invention, there is provided a nonreturn accessory, for example a nonreturn valve or a nonreturn flap, disposed in the second outlet. This nonreturn accessory ensures that the condensate which is centrifuged off can automatically be supplied again from the apparatus to, for example, a reactor pressure vessel. The nonreturn flap ensures that the cooling liquid, which is under a pressure of 70 bar in a reactor pressure vessel of a boiling water reactor plant, cannot flow back into the apparatus. With the nonreturn flap closed, a pressure then builds up in the entry region due to an increasing condensate quantity, with the pressure depending essentially on the thickness of the condensate layer forming at the edge of the entry region. When this internal pressure exceeds the pressure in the reactor pressure vessel, the nonreturn flap opens and the condensate can flow off into the reactor pressure vessel. The nonreturn flap closes automatically as soon as the internal pressure is once again lower than the pressure prevailing in the reactor pressure vessel due to the decrease in thickness of the condensate layer.

With the objects of the invention in view there is also provided an apparatus which is used in a nuclear power station, in particular in a nuclear power station with a boiling water reactor, for converting the saturated steam generated in the reactor pressure vessel into hot steam and into condensate.

Other features which are considered as characteristic for the invention are set forth in the appended claims.

Although the invention is illustrated and described herein as embodied in a method and an apparatus for the superheating of steam, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
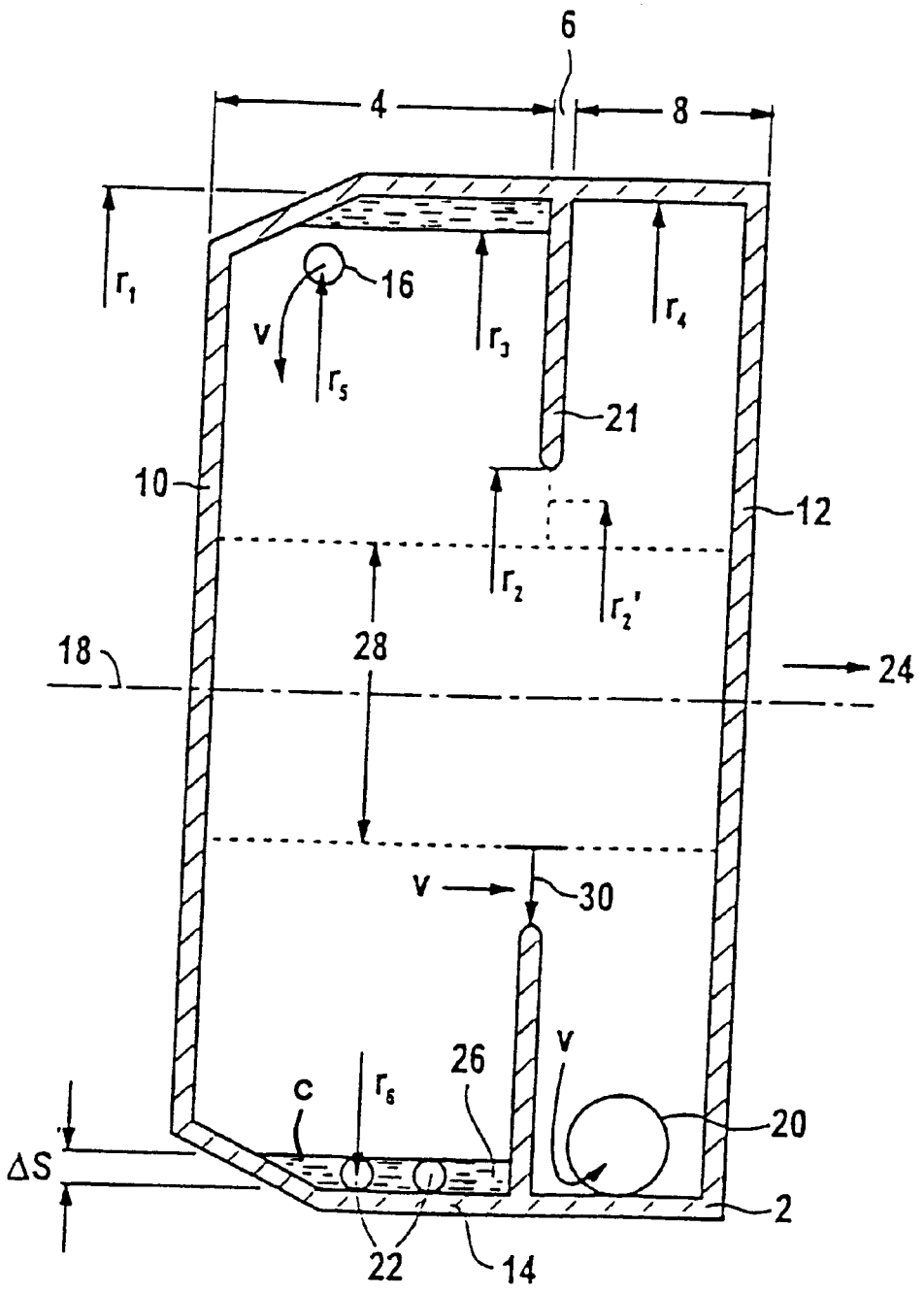
FIG. 1 is a diagrammatic, sectional view taken along an axis of rotation of an apparatus for the superheating of steam according to the invention.

Referring now to the figures of the drawings in detail and first, particularly, to FIG. 1 thereof, there is seen an apparatus for the superheating of steam v which has a chamber 2. The chamber 2 includes an entry region 4, a transitional region 6 and an exit region 8. In order to assist the buildup of a rotational flow in the chamber 2, the latter is advantageously rounded, that is to say it has essentially no corners and sharp edges, so as to avoid unnecessary flow resistances for the rotational flow, for example due to vortex formation. In particular, the chamber 2 is rotationally symmetrical about an axis of rotation, for example it is cylindrical. An elliptic cross-section of the chamber 2 is also possible instead of a circular cross-section of the cylindrical chamber 2.

The chamber 2 is delimited on the same side as the entry region 4 by a first end surface 10, on the same side as the exit region 8 by a second end surface 12, as well as by a shell 14 which includes the entry region 4, the transitional region 6 and the exit region 8. An inlet 16, through which a fluid, in particular steam v, enters the chamber 2 with a predominantly tangential direction of flow, is disposed in the entry region 4. The steam v can flow through the chamber 2 along its axis of rotation 18 in the direction of the exit region 8. The steam v, which is present as hot steam in the exit region 8, can emerge again from the chamber 2 through a first outlet 20 disposed in the exit region 8.

The chamber 2 has a cross-sectional narrowing in the transitional region 6 which is disposed between the entry region 4 and the exit region 8. According to FIG. 1, the cross-sectional narrowing is formed by an annular perforated diaphragm 21 which is disposed perpendicularly to and on the shell 14 and which leaves free an orifice for the steam v to flow through in the vicinity of the axis of rotation 18. The cross-sectional area, through which the steam v can flow, decreases in the transitional region 6 along the axis of rotation 18 by virtue of this barrier. In other words, a radius $r_1$ of the entry region 4 is reduced to a radius $r_2$ of the transitional region 6. The chamber 2 subsequently widens to a radius $r_4$ in the exit region 8. A second outlet 22 is disposed in the entry region 4 in addition to the inlet 16. In this case, the inlet 16 is disposed nearer to the axis of rotation 18 than the second outlet 22. A distance $r_5$ between the axis of rotation 18 and the inlet 16 is therefore smaller than a distance $r_6$ between the axis of rotation 18 and the second outlet 22.

The inlet 16 is disposed in the entry region 4 in the vicinity of the first end surface 10. In order to assist the buildup of a rotational flow of the steam v in the chamber 2, the inlet 16 is advantageously disposed tangentially to the shell 14 of the chamber 2. In other words, the inlet 16 is disposed in such a way that the entering steam v flows, for example circularly, into the chamber 2 along the shell 14, to be more precise essentially perpendicularly to the axis of rotation 18, so as to form a rotational or swirl flow. The rotational or circulatory flow of the steam v has superposed on it an axial flow component along the axis of rotation 18 towards the exit region 8. The flow therefore also has in addition to the rotating component, the rotational flow, a component with an axial direction of flow 24 which runs essentially along the axis of rotation 18 from the entry region 4 into the exit region 8. In this case, the axis of rotation 18 of the chamber 2 is largely identical to the axis of rotation 24 of the rotational flow of the steam v. In order to make it easier for the rotational flow to build up, the first end surface 10 is beveled or rounded relative to the shell 14.

The second outlet 22 serves for discharging a condensate c that is centrifuged off. The outlet is preferably disposed directly on the shell 14 in the entry region 4. It is particularly advantageous to likewise place this second outlet 22 tangentially to the shell 14, specifically in such a way that the second outlet 22 is disposed in the direction of the tangential flow component, that is to say in the direction of the rotational flow. In other words, the condensate c that is centrifuged off, which has the same direction of rotation as the rotating steam v, flows towards an orifice of the second outlet 22, so that the kinetic energy of the flow is largely converted into pressure, specifically in the form of a dynamic pressure. For this purpose, the second outlet 22 may extend, for example as a tube, into the chamber 2. The first outlet serves for discharging the hot steam which is generated. The outlet is preferably likewise disposed tangentially on the shell 14 of the chamber 2 and, like the second outlet 22, in the direction of the rotational flow. The form of the first outlet 20 and of the second outlet 22 is largely freely selectable. The two outlets may, for example, have circular, oval, rectangular or else gap-like outlet orifices. In order to obtain the tangential configuration, the two outlets may be formed, for example, by one or more tubes extending into the chamber 2. The number and structure of the two outlets 20, 22 may differ.

This apparatus for the superheating of steam functions as follows: the steam v, which, for example, is under pressure in a pressure vessel, enters the entry region 4 through the inlet 16, with a rotational flow being formed at the same time.

During this expansion, the pressure energy of the steam v is converted at least partially into kinetic energy. In order to convert as high a fraction of the pressure energy as possible into kinetic energy, the inlet 16 is advantageously constructed as a simple nozzle, so that if suitable pressure conditions are present, a rotational flow having virtually sound velocity forms as early as at the inlet 16. A construction as a Laval nozzle would also be possible, in which (if pressure conditions suitable for this are present) the entering steam v is already at supersonic velocity. As a result of the expansion of the steam v, both its pressure and its temperature decrease. Liquid thereby condenses out of the steam v. The condensation heat occurring at the same time is absorbed by the steam v. The liquid which is condensed out is centrifuged off as a result of the rotational velocity and accumulates on the shell 14 as the condensate c.

Due to the inflowing steam v, a pressure gradient occurs between the entry region 4 and the exit region 8, with the axial direction of flow 24 being formed as a result of the gradient, so that the steam v flows from the entry region 4 into the exit region 8. In this case, the transitional region 6 constitutes a barrier for the steam v which has to be overcome. Due to the narrowing of the flow cross-section, the rotational velocity of the rotational flow increases as a consequence of the principle of conservation of angular momentum, to be precise this occurs approximately linearly in relation to the reduction of the radius of the rotating flow in the entry region (corresponding to the radius $r_5$) to a radius $r_{2'}$ which the rotational flow has on average in the transitional region 6 (the rotational flow has an extent in the radial direction). Therefore, when the radius of the rotating flow is halved in the transitional region 6, the flow velocity is doubled. In this case, the pressure and temperature of the steam v are further reduced, and even more condensate c accumulates on the shell 14. The condensate c remains in the entry region 4 due to the barrier formed by the transitional region 6, and the steam v which is not condensed out, the residual steam, flows with a low moisture content, that is to say with a small fraction of liquid, into the exit region 8.

As a result of the increase in the cross-sectional area of the chamber 2 to the radius $r_4$ in the exit region 8, the kinetic energy of the rotational flow is once again converted predominantly into pressure energy. By virtue of the above-described special configuration of the first outlet 20, the velocity w of the steam v can be virtually completely converted into pressure energy again. The opposite process to that which occurs in the entry region 4 therefore takes place in the exit region 8: after the pressure energy has been converted into kinetic energy of the steam in the entry region 4, the kinetic energy is then converted into pressure energy again. In this case, the temperature and pressure of the steam v rise again in the exit region 8. Since it was possible for the steam v to absorb condensation heat in the entry region 4 as a result of condensation, then an essentially higher temperature prevails in the exit region 8, so that the steam v originally flowing in as saturated steam leaves the apparatus for the superheating of steam v as superheated steam v or hot steam.

The condensate c is led out of the chamber 2 through the second outlet 22. The second outlet 22 may first be closed in order to build up a pressure in the condensate c in order, for example, to convey the condensate c into the pressure vessel again counter to the pressure prevailing in the latter. With the second outlet 22 closed, a rotating condensate layer 26 having a thickness Δs forms in the chamber 2. The rotating condensate layer has a radius $r_3$. A static pressure forms generally at a radius r due to the centrifugal forces occurring as a result of the rotational flow. A pressure buildup Δp in the condensate layer 26, which is a buildup that is in addition to the static pressure, is determined essentially by the product of the density ρ of the condensate c, the centrifugal acceleration b and the thickness Δs of the condensate layer 26 according to the following equation:

$$\Delta p = \rho * b * \Delta s = \rho * \frac{w^2}{r} * \Delta s$$

in which w is the rotational velocity and r is the radius of the rotating condensate c. The condensate c can then be conveyed out of the chamber 2 into the pressure vessel at sufficient pressure, that is to say in the case of a sufficient thickness Δs of the condensate layer 26.

Due to the rotational flow, a pressure rise forms in the chamber in the radial direction, that is to say from the axis of rotation 18 toward the shell 14. In particular, a vacuum prevails in a central region 28 about the axis of rotation 18, so that in the transitional region 6, the steam v overflows virtually completely into the exit region 8 through an outer region 30.

Figure 2:
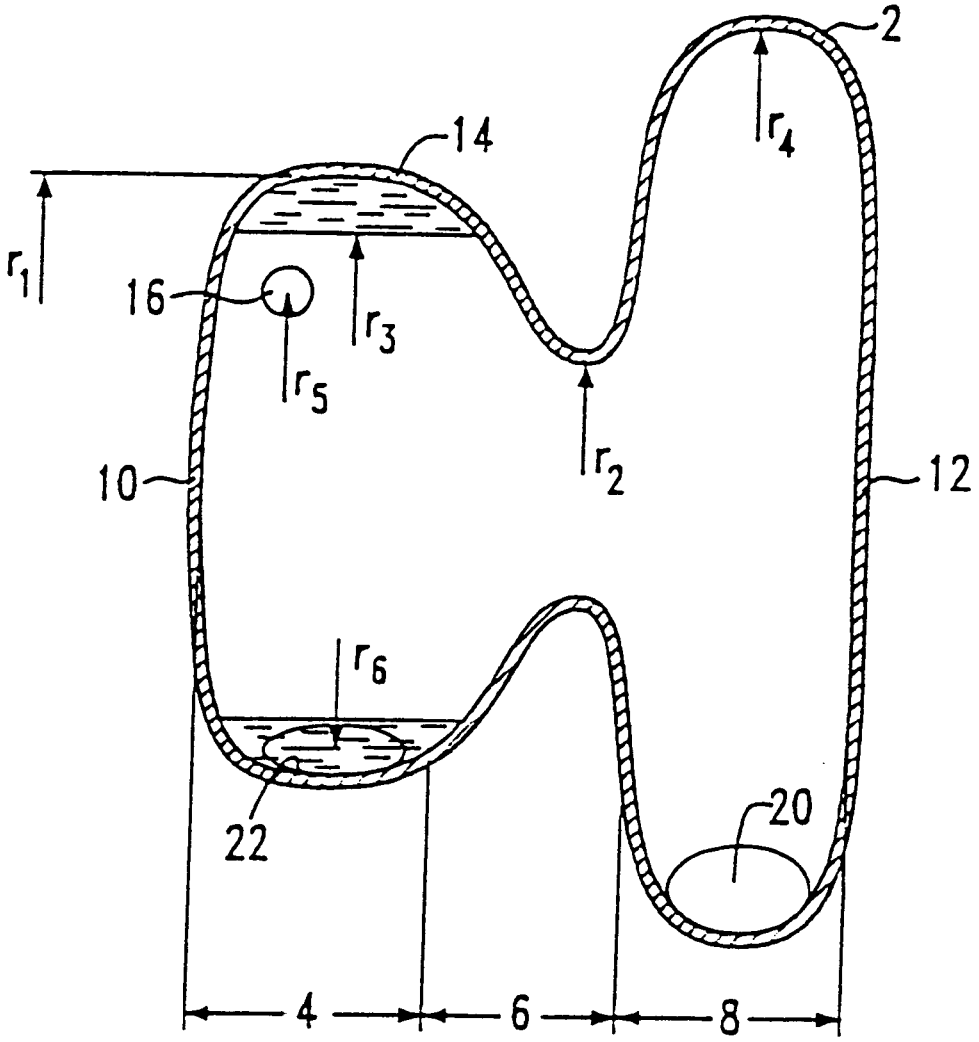
FIG. 2 is a sectional view likewise taken along the axis of rotation of an alternative embodiment of the apparatus.

According to FIG. 2, the chamber 2 has a kind of contraction as a transitional region 6. The cross-sectional narrowing of the chamber 2 in the transitional region 6 is therefore obtained by arching the chamber 2 inward. The chamber 2 widens continuously from the transitional region 6 both to the entry region 4 and to the exit region 8, that is to say no abrupt transitions occur between the individual regions, in order to make it possible to have a flow which is as free of friction and of vortices as possible. In order to convert a high fraction of the kinetic energy into pressure energy again, the radius $r_4$ of the exit region 8 is greater than the radius $r_1$ of the entry region 4. According to FIG. 2, the second outlet 22 has an oval structure.

The contraction of the chamber 2 for narrowing the cross-section and consequently for increasing the rotational velocity is particularly advantageous. In contrast to this, however, it is also possible for the contraction to be interpreted merely as a barrier to the condensate c, so that the condensate c which is centrifuged off cannot overflow into the exit region 8. This purpose is also served by a kind of condensate gutter or condensate trough in the entry region 4.

The change in cross-section of the chamber 2 in the direction of axial flow for varying the rotational velocity in order to convert the kinetic energy into pressure energy, and vice versa, is likewise particularly advantageous. However, the conversion of kinetic energy into pressure energy in the exit region 8 may also be achieved by a suitable tangential configuration of the first outlet 20 in the direction of the rotational flow, instead of by increasing the cross-sectional area.

Figure 3:
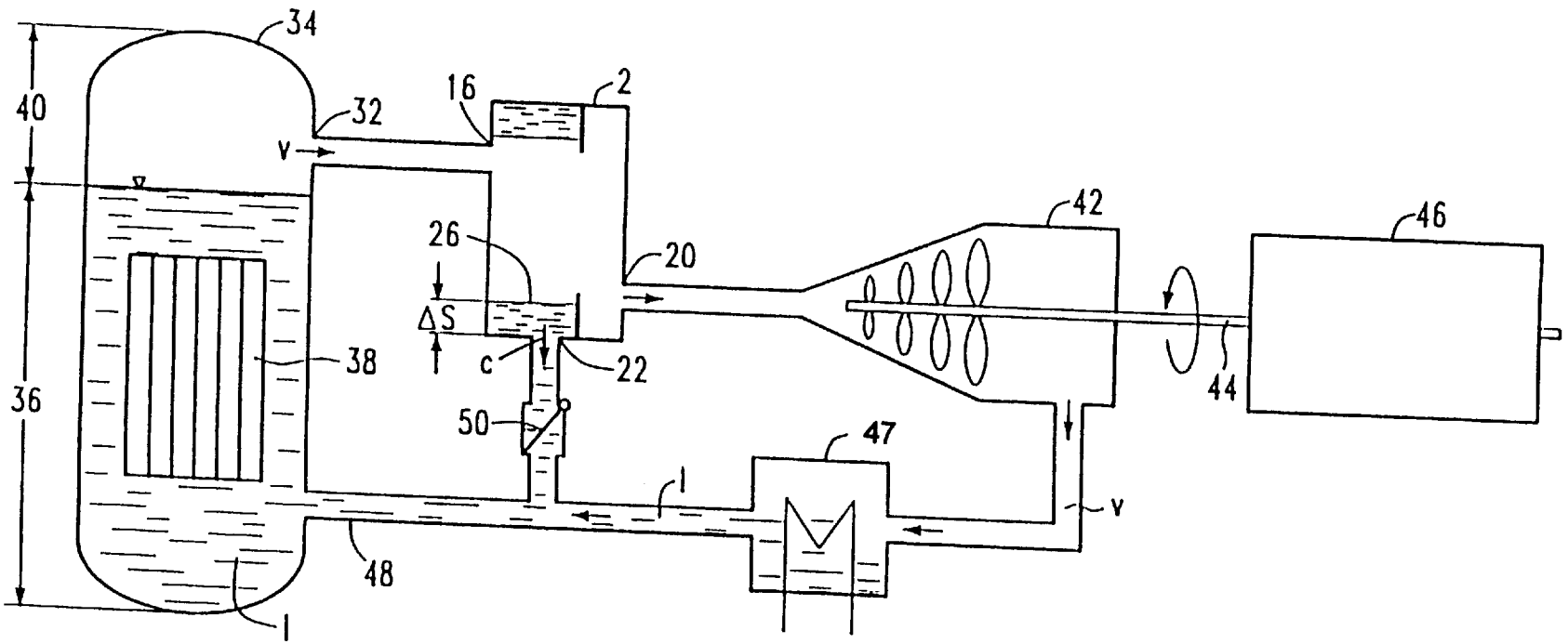
FIG. 3 is a diagram of a portion of a steam/water circuit of a boiling water reactor.

According to FIG. 3, the chamber 2 of the apparatus for the superheating of steam is connected to a steam outlet connection 32 of a reactor pressure vessel 34 of a boiling water reactor. The reactor pressure vessel 34 is partially filled with a cooling liquid 1, for example water. A reactor core 38, together with non-illustrated fuel assemblies, is disposed in a liquid region 36 formed by the cooling liquid 1. The cooling liquid 1 is heated and steam v occurs as a consequence of fission processes in the reactor core, with the steam accumulating in a steam region 40 above the liquid region 36. The steam v enters the chamber 2 through the inlet 16 by way of the steam outlet connection 32. Part of the steam v is precipitated as condensate c in the chamber 2 and leaves the chamber 2 through the second outlet 22. The residual steam which is not condensed out leaves the chamber 2 as hot steam through the first outlet 20 and drives a turbine 42. The turbine 42 is connected by a shaft 44 to a generator 46 for generating electric energy.

The steam v leaves the turbine 42 and is cooled by cooling water circulation as a result of heat exchange processes in a heat exchanger 47, so that the steam v condenses completely and can be supplied to the reactor pressure vessel 34 again as cooling liquid 1 through an inlet connection 48. The condensate c which is condensed out in the chamber 2 is likewise supplied to the reactor pressure vessel 34 as cooling liquid 1. However, in order to prevent the cooling liquid 1 from flowing back into the chamber 2 from the reactor pressure vessel 34, a nonreturn accessory, in particular a nonreturn flap 50, is disposed in the second outlet 22.

As long as the pressure of the cooling liquid 1 in the reactor pressure vessel 34 exceeds the pressure of the condensate c in the condensate layer 26 in the chamber 2, the nonreturn flap 50 is closed. When the nonreturn flap 50 is closed, the thickness Δs of the condensate layer 26 increases, with the result that the pressure in this condensate layer 26 is increased according to the above-stated equation. When this pressure exceeds the pressure prevailing in the reactor pressure vessel 34, the nonreturn flap 50 opens automatically, and the condensate c can flow as cooling liquid 1 into the reactor pressure vessel 34. In this case, the thickness Δs of the condensate layer 26 is reduced and the pressure prevailing there, which is the internal pressure, decreases again, until it falls below the pressure prevailing in the reactor pressure vessel 34, that is the external pressure. As soon as this occurs, the nonreturn flap 50 closes again automatically and the process of the buildup of pressure in the condensate layer 26 commences again. Pressure buildup and outflow of the condensate c from the chamber 2 counter to an external pressure are therefore regulated automatically, that is to say without any external influences. Through a suitable choice of the boundary conditions, it is possible to ensure that this operation is not constantly repeated cyclically, but that a stationary state forms, in which the condensate mass flow discharged from the chamber 2 is always the same magnitude as the mass flow precipitated in the chamber 2.

In contrast to FIG. 3, the chamber 2 may also be disposed completely within the reactor pressure vessel 34 and the first outlet 20 may be connected to the turbine 42 through a steam line. This dispenses with a special return line for the precipitated condensate and with constructing the chamber 2 for the full operating or incident pressure.

Through the use of an apparatus for the superheating of steam v in a water/steam circuit of a nuclear power plant, the steam v is separated from the water/steam mixture and the turbine is driven by hot steam. This apparatus for the superheating of steam v, on one hand, affords the possibility of replacing the complicated apparatuses for steam/water separation, for example steam driers in boiling water reactors. On the other hand, such an apparatus affords the possibility of operating the turbine 42 with hot steam, instead of with saturated steam, and thus avoiding the difficulties which are caused by the impingement of water drops onto turbine blades.

Figure 4:
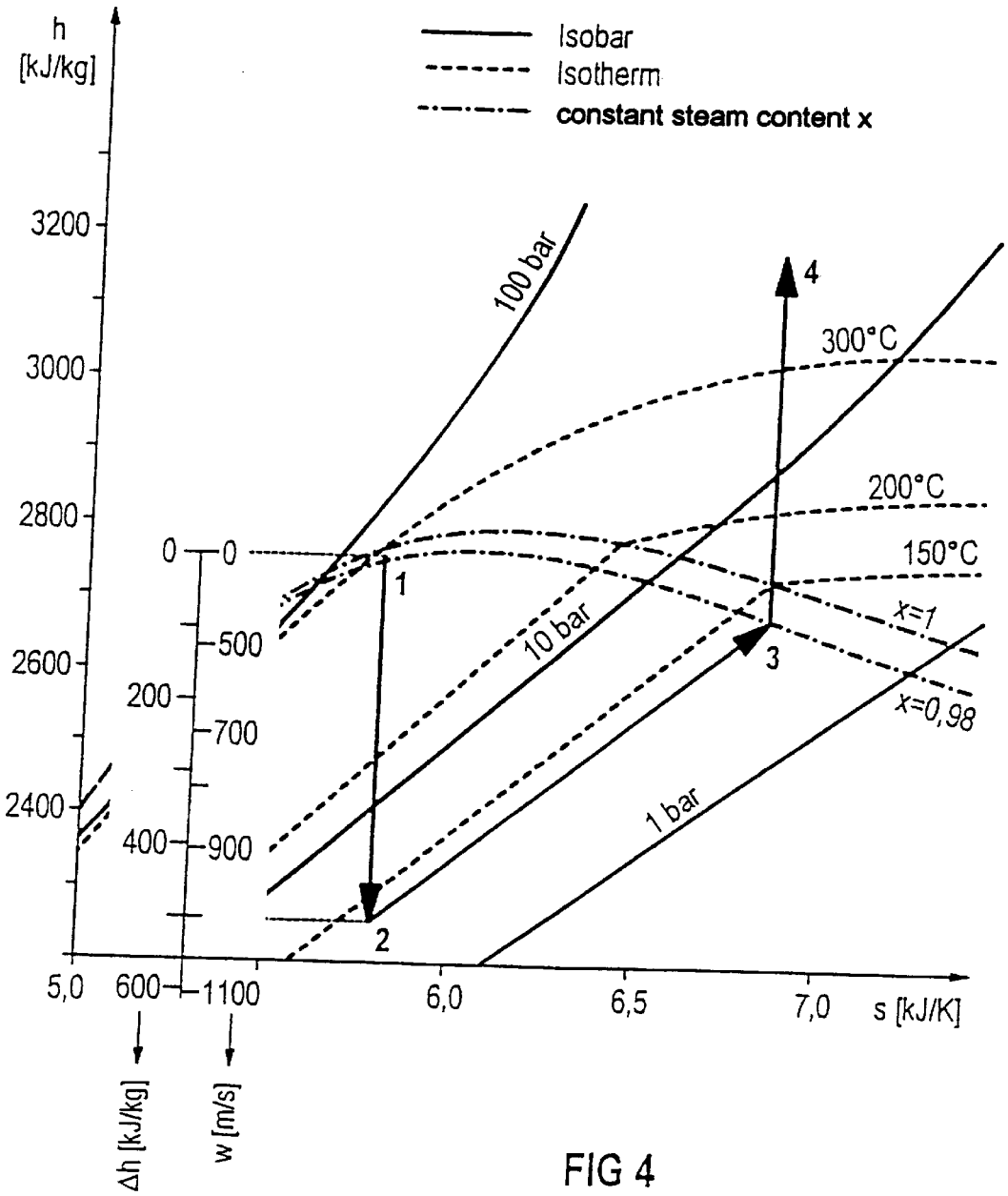
FIG. 4 is a Mollier diagram outlining physical processes of the method according to the invention.

The physical processes of such a method for the superheating of steam will now be explained with reference to FIG. 4. FIG. 4 outlines a portion of a Mollier enthalpy (h)/entropy (s) diagram. The enthalpy h is indicated in kJ/kg on the ordinate and the specific entropy s in kJ/(Kg*K) on the abscissa. The unbroken lines in this diagram are isobars, the dashed lines are isotherms and the dot-dash lines are curves along which the steam content x is constant. A steam content x=1 means that no liquid drops being condensed out are contained in the steam. In contrast, a steam content x of 0.6 means that a liquid/steam mixture is present, with a mass fraction of the steam being 60% and that of the liquid being 40%. Saturated steam is present along a curve of x=1. Below this curve, that is to say with a steam content x<1, there is wet steam, and above the saturated steam line at x=1 there is superheated steam. Arrows between points 1–4 indicate individual physical changes of state which are explained in more detail below:

In a reactor pressure vessel 34 of a boiling water reactor, the pressure of the steam v is typically 70 bar and the temperature is approximately 286° C. This point is marked by the numeral 1 in the Mollier h/s diagram. When the steam v flows into the chamber 2, its pressure and temperature are reduced and its velocity simultaneously increases. If the phase separation and frictional effects occurring in this case are initially ignored, this occurrence may be interpreted as adiabatic expansion. In the Mollier diagram, this corresponds to a vertical downward line. A relation can be made between the specific enthalpy h and the velocity w of the flow for such adiabatic expansion. This relation is incorporated as a scale in the Mollier diagram. An enthalpy change Δh is plotted linearly in kJ/kg on the left side of this scale and the velocity w is plotted in m/s on the right side. If a critical pressure ratio is assumed during inflow into the chamber 2, that is to say the pressure of the steam v is reduced from 70 bar originally to approximately 40 bar, then a rotational velocity of approximately 450 m/s is initially obtained. In the case of a reduction of the radius of the rotational flow from $r_5$=1.5 meters to $r_{2'}$=0.7 meters in the transitional region, a rotational velocity of approximately 965 m/s is then obtained. Moreover, if an axial flow velocity of approximately 300 m/s is taken as a basis, this results in an average flow velocity w of the steam v of approximately 1000 m/s. Since the steam v in the reactor pressure vessel 34 previously had virtually no velocity w, the enthalpy change Δh corresponds to 1000 m/s along the adiabatic line from point 1 to point 2. It can then be read off from the Mollier diagram that the steam would expand to a pressure of approximately 3.5 bar and would reach a steam content of x=0.78.

The phase separation which has been ignored heretofore is then taken into account in the step from point 2 to point 3. During phase separation, the pressure of the steam/water mixture remains constant, that is to say phase separation takes place along an isobar in the Mollier diagram. The steam content x increases continuously during phase separation, that is to say the steam/water mixture becomes increasingly leaner in liquid or richer in steam. Due to the very high rotational velocity of the flow, the liquid drops which are condensed out are centrifuged off extremely effectively, so that a residual moisture of, for example, 2% can be achieved in the residual steam which remains. This corresponds to a steam content of x=0.98. An intersection point of the isobar at 3.5 bar and of the curve of constant steam content x=0.98 thus defines the point 3. The steam v, which overflows into the exit region 8, is therefore defined by the point 3 in the Mollier diagram under the above preconditions.

The opposite physical process to that in the entry region 4 then takes place in the exit region 8. The existing kinetic energy of the flow is again converted into enthalpy h. Since a rotational flow may be considered primarily as being free of friction, and since, due to the above-described special structure of the first outlet 20, the velocity can be reduced virtually to 0 again, the enthalpy change Δh to be plotted in the Mollier diagram primarily corresponds once again to a velocity w of 1000 m/s. The process from point 3 to point 4 may once again, like the process from point 1 to point 2, be interpreted as an adiabatic change of state, since there is no heat exchange. In the Mollier diagram, this is therefore represented once more by a vertical line from point 3 to point 4. As is evident from the Mollier diagram, in this case the steam v overflows from the wet steam zone (x<1) into the hot steam zone. According to the above assumptions, the steam reaches a temperature of 380° C. at a pressure of approximately 31 bar. The steam is therefore approximately 95° k hotter than the saturated steam generated in the reactor pressure vessel.

In contrast, the pressure has decreased from 70 bar to less than half, namely 31 bar. In relation to this pressure of 31 bar, the superheating of the steam v amounts to approximately 144 K.

A measurement of how high the fraction of hot steam leaving the chamber 2 is, as measured with reference to the total steam entry into the chamber 2, can be obtained according to the continuity and energy equation from the following equation:

$$m_0 h_0 = m_3\left(h_3 + \frac{w_3^2}{2}\right) + (m_0 - m_3) * \left(h_c + \frac{w_c^2}{2}\right)$$

In this case, the subscript 0 relates to the state of the steam v in the reactor pressure vessel, and the subscript 3 relates to the state of the steam v prior to overflow into the exit region 6 and corresponds to the state of the steam at point 3 of the Mollier diagram. The subscript c designates the corresponding quantities for the condensate c in the entry region 4 and designates the respective mass.

By virtue of the centrifugal forces arising as the result of the rotational flow, the condensate c is under a pressure of approximately 43 bar in the case of a radius $r_3$=1.6 m. Since the condensate c heats up until this saturation pressure is reached, its specific enthalpy $h_c$=1110 kJ/kg. The rotation velocity of the condensate c is, for example, approximately w=200 m/s as a consequence of frictional effects between the shell 14 and the condensate c. The values of the specific enthalpy $h_0$ and $h_3$ may be inferred from the Mollier diagram. As stated above, the velocity $w_3$ is approximately 1000 m/s. With these values, a mass fraction of approximately 79.2% is obtained for the steam v and approximately 20.8% is separated as condensate, that is to say a very large mass fraction of the saturated steam leaves the apparatus for the superheating of steam as steam v which can then drive a turbine with high thermal efficiency.

The numerical examples listed above serve solely for explaining the fundamental operating mode of the method and apparatus for the superheating of steam. No limitation either of the geometric quantities of the chamber or of the thermodynamic quantities, such as pressure, temperature or velocity, are to be seen in them.

I claim:

1. A method for the superheating of steam, which comprises:

a) at least partially converting a pressure energy of steam into a rotational flow about an axis of rotation and into an axial flow superposed on the rotational flow and flowing in direction of the axis of rotation;

b) increasing a rotational velocity of the steam in the direction of the axis of rotation by reducing a flow cross-section while generating condensate and residual steam;

c) separating the condensate from the residual steam upstream of the reduction of the flow cross-section and subsequently discharging the condensate essentially radially outward; and d) further conveying the residual steam in the direction of the axis of rotation while reducing the rotational velocity of the residual steam and superheating and converting the residual steam into hot steam.

2. The method according to claim 1, which comprises forming the rotational flow by introducing the steam into a chamber tangentially to a shell of the chamber and approximately perpendicularly to the axis of rotation, and guiding a flow of the steam through the chamber in the direction of the axis of rotation.

3. The method according to claim 2, which comprises discharging the condensate from the shell.

4. The method according to claim 3, which comprises collecting the condensate on the shell of the chamber before discharging the condensate from the shell.

5. A method for generating hot steam from saturated steam in a nuclear power plant, which comprises:

a) generating saturated steam in a reactor pressure vessel of a boiling water reactor plant;

b) at least partially converting pressure energy of the saturated steam into kinetic energy of a rotational flow of the saturated steam while generating residual steam and condensate;

c) at least partially separating the condensate from the residual steam; and d) subsequently reducing the kinetic energy of the rotational flow of the residual steam and superheating and converting the residual steam into hot steam.

6. An apparatus for the superheating of steam, comprising:

a) a chamber having an axis of rotation and extending in direction of said axis of rotation;

b) said chamber having an entry region for at least partially converting pressure energy of steam into kinetic energy of the steam and for separating a condensed-out condensate from remaining residual steam, said entry region having a given cross-sectional area;

c) said chamber having a transitional region following said entry region for increasing the kinetic energy, said transitional region having a cross-sectional area smaller than said given cross-sectional area;

d) said chamber having an exit region following said transitional region for reducing kinetic energy of the residual steam and for converting the residual steam into hot steam, said exit region having a cross-sectional area larger than said cross-sectional area of said transitional region; and e) said exit region having a first outlet for the hot steam, said entry region having a second outlet for the condensate, and said second outlet spaced radially from said axis of rotation.

7. The apparatus according to claim 6, wherein said chamber is substantially free of internal fixtures.

8. The apparatus according to claim 6, wherein said chamber is essentially rotationally symmetrical and has an inlet in said entry region for forming a rotational flow in said entry region.

9. The apparatus according to claim 8, wherein said chamber has a shell, and said inlet is disposed tangentially to said shell and essentially perpendicularly to said axis of rotation.

10. The apparatus according to claim 8, wherein said inlet is a nozzle.

11. The apparatus according to claim 9, wherein said first outlet is disposed tangentially and essentially perpendicularly to said axis of rotation and is disposed on said shell in a rotational flow direction.

12. The apparatus according to claim 9, wherein said second outlet is disposed tangentially relative to said shell and essentially perpendicularly relative to said axis of rotation.

13. The apparatus according to claim 6, wherein said second outlet is disposed in flow direction of a rotational flow.

14. The apparatus according to claim 8, wherein said second outlet is spaced further from said axis of rotation than said inlet.

15. The apparatus according to claim 6, including a non-return accessory disposed in said second outlet.

16. A nuclear power station, comprising:

an apparatus for superheating steam and for converting saturated steam into hot steam and condensate, said apparatus including:

a) a chamber having an axis of rotation and extending in direction of said axis of rotation;

b) said chamber having an entry region for at least partially converting pressure energy of steam into kinetic energy of the steam and for separating a condensed-out condensate from remaining residual steam, said entry region having a given cross-sectional area;

c) said chamber having a transitional region following said entry region for increasing the kinetic energy, said transitional region having a cross-sectional area smaller than said given cross-sectional area;

d) said chamber having an exit region following said transitional region for reducing kinetic energy of the residual steam and for converting the residual steam into hot steam, said exit region having a cross-sectional area larger than said cross-sectional area of said transitional region; and e) said exit region having a first outlet for the hot steam, said entry region having a second outlet for the condensate, and said second outlet spaced radially from said axis of rotation.

17. The nuclear power station according to claim 16, including a boiling water reactor.

* * * * *